US007445529B2

(12) United States Patent
Takizawa et al.

(10) Patent No.: US 7,445,529 B2
(45) Date of Patent: Nov. 4, 2008

(54) CONNECTOR STRUCTURE AND CONNECTOR TYPE TERMINAL BLOCK STRUCTURE

(75) Inventors: Keiji Takizawa, Toyota (JP); Kei Fujimoto, Makinohara (JP)

(73) Assignees: Toyota Jidosha Kabushiki Kaisha, Aichi-Ken (JP); Yazaki Corporation, Tokyo (JP)

( * ) Notice: Subject to any disclaimer, the term of this patent is extended or adjusted under 35 U.S.C. 154(b) by 0 days.

(21) Appl. No.: 11/686,071

(22) Filed: Mar. 14, 2007

(65) Prior Publication Data

US 2007/0218736 A1 Sep. 20, 2007

(30) Foreign Application Priority Data

Mar. 16, 2006 (JP) ..... 2006-072409

(51) Int. Cl.
*H01R 13/187* (2006.01)

(52) U.S. Cl. ..... 439/845

(58) Field of Classification Search ..... 439/845, 439/846, 843, 844, 849
See application file for complete search history.

(56) References Cited

U.S. PATENT DOCUMENTS 4,838,816 A * 6/1989 Matsusaka et al. ..... 439/861
7,150,660 B2 * 12/2006 Allgood et al. ..... 439/845

FOREIGN PATENT DOCUMENTS

JP 2003-317821 A 11/2003
JP 2005-229755 A 8/2005

* cited by examiner

*Primary Examiner*—Phuong K Dinh
(74) *Attorney, Agent, or Firm*—Sughrue Mion, PLLC

(57) ABSTRACT

A connector structure that can ensure connection is provided. In the connector structure, a bus bar and a plate-like terminal mate with each other to establish an electric connection. A lower-side inner surface as a first inner surface defining the opening is provided with a plurality of conductive rotary members that rotate in a direction substantially perpendicular to a direction in which the plate-like terminal is inserted. It is also provided with a frame member that holds the rotary members and that is connected to the bus bar. The rotary members are twisted relative to the frame member and thereby biased relative to the plate-like terminal. By the plate-like terminal being inserted into and pulled out from the bus bar, the rotary members receive force from the plate-like terminal and rotate within a plane substantially perpendicular to a direction in which the plate-like terminal is inserted and pulled out.

5 Claims, 5 Drawing Sheets

CONNECTOR STRUCTURE AND CONNECTOR TYPE TERMINAL BLOCK STRUCTURE

This nonprovisional application is based on Japanese Patent Application No. 2006-072409 filed with the Japan Patent Office on Mar. 16, 2006, the entire contents of which are hereby incorporated by reference.

BACKGROUND OF THE INVENTION

1. Field of the Invention

The present invention relates to a connector structure and to a connector type terminal block structure. More specifically, the present invention relates to a connector structure connected to a rotating electric machine incorporated in a vehicle and to a connector type terminal block structure using the same.

2. Description of the Background Art

Conventionally, a connector type terminal block structure has been disclosed in Japanese Patent Laying-Open No. 2005-229755, for example.

The publication discloses a technique in which a flexible member is provided between a winding and a terminal block in order to absorb the tolerance of components in assembling the varnished motor winding to the terminal.

Although in the conventional terminal structure a contact point corresponding to "a first contact point" for connecting a feeding cable and an inner conductor has been provided, there has been a problem that an electric connection by the contact point is not fully ensured.

SUMMARY OF THE INVENTION

The present invention has been made to solve the problem described above, and an object thereof is to provide a connector structure and a connector type terminal block structure that can further ensure an electric connection between a first connector component and a second connector component.

A connector structure according to the present invention includes: a first connector component; and a second connector component mating with the first connector component to ensure an electric connection. An opening into which the second connector component is inserted is formed at the first connector component. A first inner surface defining the opening is provided with a plurality of conductive rotary members that abut on the second connector component and that rotate in a direction substantially perpendicular to a direction in which the second connector component is inserted, and a frame member that holds the rotary members and that is connected to the first connector component. The rotary members are twisted relative to the frame member and thereby biased relative to the second connector component. By the second connector component being inserted into and pulled out from the first connector component, the rotary members receive force from the second connector component and rotate within a plane substantially perpendicular to a direction in which the second connector component is inserted and pulled out. The frame member and the rotary members are formed from working of a common conductive plate.

In the connector structure as configured above, the rotary members are twisted relative to the frame member and thereby biased relative to the second connector component. Therefore, by changing the width of a connecting portion between the frame member and the rotary members, the biasing force to the rotary member toward the second connector component can be adjusted. As a result, the contacting force between the second connector component and the rotary members can be changed as appropriate to realize the ensured connection. Additionally, since the frame member and the rotary members are formed from working of a common conductive plate, the manufacturing costs can be reduced relative to the case where the frame member and the rotary members are formed with separate members.

Preferably, a tip portion of each of the rotary members is provided with a tilt surface that is tilted relative to a direction in which the second connector component is inserted into the first connector component.

In this case, the tilt surface contacts the second connector component, whereby the second connector component can smoothly be inserted.

Preferably, the opening is defined by a second inner surface opposing to the first inner surface. The first inner surface is provided with a plurality of first protrusions in a forward-backward direction of insertion of the second connector component relative to the rotary members, whereby abutment on the second connector component is enabled, and the second inner surface is provided with a second protrusion between the plurality of first protrusions that can abut on the second connector component. In this case, the second connector component is inserted into the space between the first and second protrusions. Thus, the second connector component is inserted in a narrow space. As a result, it is less likely that the second connector component is inserted from an unprescribed direction, and the second connector component does not put movable load on the rotary members. As a result, further ensured connection between the second connector member and the rotary members is realized.

A connector type terminal block structure according to the present invention includes: a base member holding the connector structure described above; a stator terminal fixed to the base member with one of the first connector component and the second connector component; and a fixing member fixing the stator terminal and the first connector component to the base member.

The connector type terminal structure configured as above achieves a structure in which the first connector component contacts the second connector component at a plurality of contacting points, and the stator terminal and the first connector component are fixed to the base member using the fixing member. As a result, even when the stator terminal vibrates, the vibration is stopped by the fixing member and the base member to prevent propagation of the vibration to the first and second connector components. As a result, the contact between the first and second connector components can further be ensured. Further, even when the rotating electric machine vibrates, the precision in the fastening position of the stator bus bar can be ensured against the vibration of the rotating electric machine.

Preferably, the connector type terminal block structure further includes a terminal cover mounted to the base member to store the connector terminal. In this case, the first and second connector components are stored in the terminal cover, whereby the first and second connector components do not directly receive the pressure from the outside. Thus, the connecting portion between the first and the second connector components can more surely be protected.

According to the present invention, a connector structure that can further surely maintain an electric connection and a connector type terminal block structure using the same can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
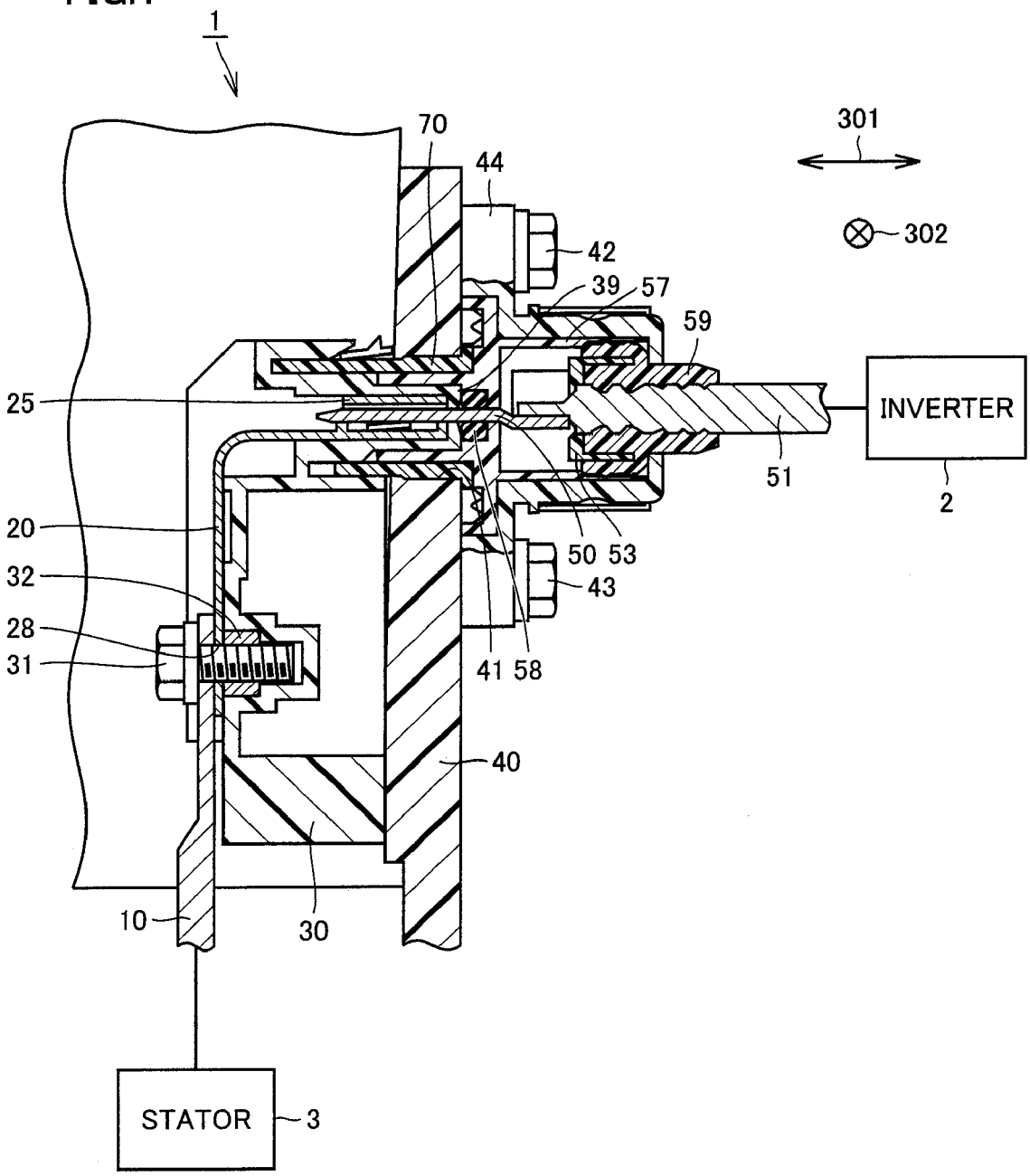
FIG. 1 is a cross-sectional view of a connector type terminal block structure according to a first embodiment of the present invention.

In the following, embodiments of the present invention will be described referring to the drawings. In the embodiments, an identical reference character is allotted to identical or corresponding parts, and description thereof is not repeated.

First Embodiment

FIG. 1 is a cross-sectional view of a connector type terminal block structure according to a first embodiment of the present invention. Referring to FIG. 1, in a connector type terminal block I according to the first embodiment of the present invention, a base member 30 is fixed to a housing 40. A nut 32 is fixed to base member 30. A bolt 31 is fastened to nut 32. Bolt 31 fixes a stator terminal 10 connected to a stator 3 and a bus bar 20.

Inverter 2 is connected to a conductor 51, which is connected to a plate-like terminal 50. Plate-like terminal 50 mates with a tip portion of bus bar 20. Conductor 51 is covered by a cap member 59, and sealed by a seal member 53. Cap member 59 is held by a cover member 44, which is fixed to housing 40 by bolts 42 and 43. Between base member 30 and seal member 57, another seal member 58 formed of an elastic body is provided.

Housing 40 stores a stator 3 constituting a rotating electric machine. Stator 3 is supplied with electric power from inverter 2. As a supply line of the electric power, conductor 51, plate-like terminal 50, bus bar 20 and stator terminal 10 are used. While bus bar 20 is "L" shaped in the present embodiment, it is not limited to this shape and a linear bus bar 20 can be employed. Furthermore, conductor 51 may be connected to a converter, a battery or the like, in place of inverter 2. Cap member 59 made of resin or rubber seals the periphery of conductor 51 extending in the longitudinal direction. Cap member 59 and conductor 51 mate with each other by grooves. In order to prevent cap member 59 from being disconnected from conductor 51, seal member 53 mates with both cap member 59 and conductor 51. Seal member 57 abuts on tip portion 39 of base member 30, sealing the portion where plate-like terminal 50 enters bus bar 20 side. A plurality of structures are provided to seal holes 41 at housing 40, in order to prevent dust or water from entering inside housing 40 (stator 3 side) from the outside.

Figure 2:
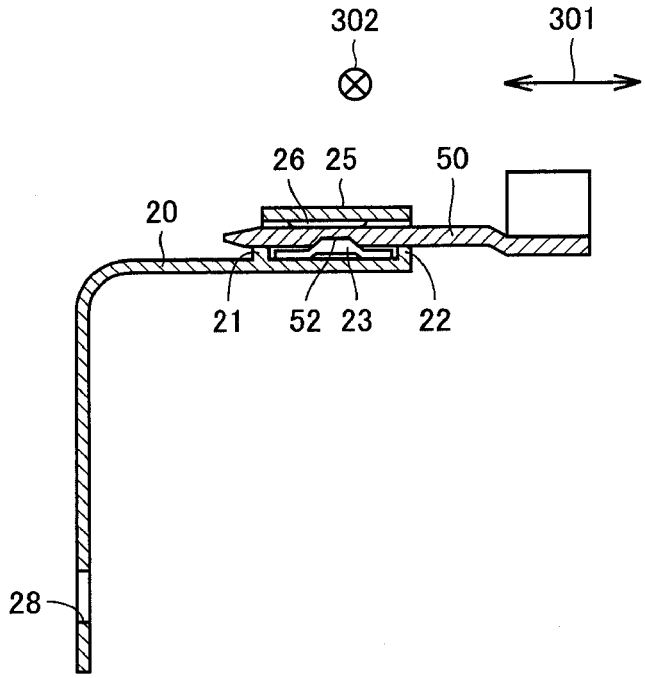
FIG. 2 is a cross-sectional view showing an enlarged view of a bus bar in FIG. 1.

FIG. 2 is a cross-sectional view showing an enlarged view of bus bar 20 in FIG. 1. Referring to FIG. 2, indents 21 and 22 are provided at an end of bus bar 20. Indents 21 and 22 are crest-like portions projecting from bus bar 20 and abut on plate-like terminal 50 being inserted. Between two indents 21 and 22 of bus bar 20, rotary members 23 are provided. Rotary members 23 are rotatable in the direction indicated by an arrow 302, and shaped to mate with a concave portion 52 of plate-like terminal 50 as a plate-like member. An indent 26 is provided at an upper surface portion 25 of bus bar 20. Indent 26 is arranged between two indents 21 and 22 of the lower side, which are arranged in the forward-backward direction. Plate-like terminal 50 is inserted into a region surrounded by indents 21, 22 and 26. Plate-like terminal 50 is inserted and pulled out in the direction shown by an arrow 301.

Figure 3:
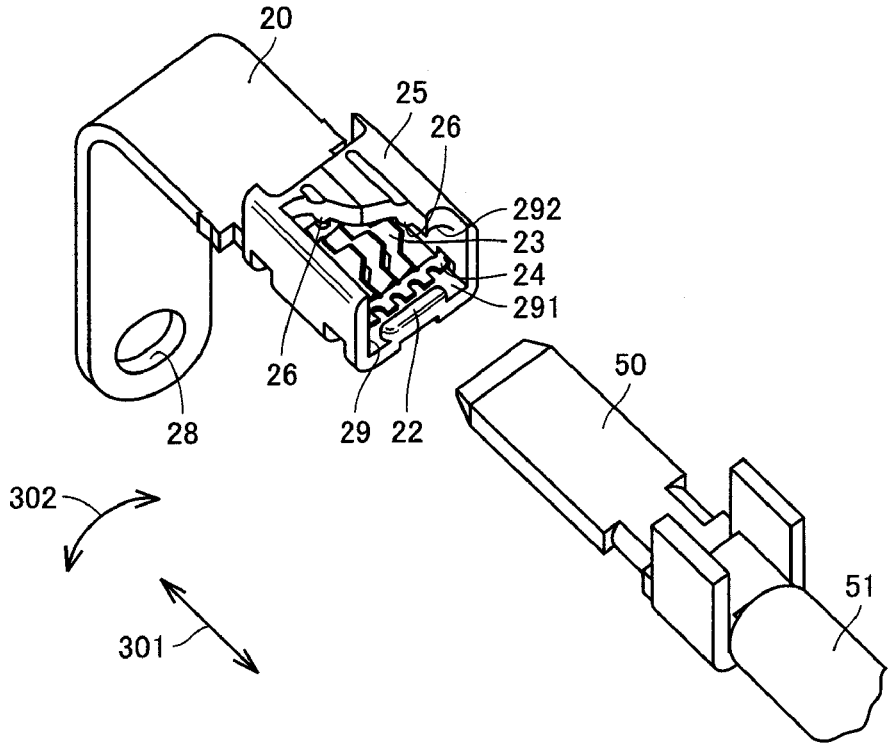
FIG. 3 is a perspective view of a bus bar.

FIG. 3 is a perspective view of the bus bar. Referring to FIG. 3, bus bar 20 of a flat-plate shape is bent, having one end provided with a hole 28 and having the other end provided with a connector region. In the connector region, a frame member 24 and rotary members 23 are provided on a lower-side inner surface 291. Frame member 24 extends laterally and contacts bus bar 20. A plurality of rotary members 23 are each plate-like, being rotatable in the direction shown by an arrow 302 and capable of abutting on plate-like terminal 50. Rotary members 23 made of a conductor contact bus bar 20 with frame member 24 interposed therebetween, which is similarly made of a conductor. An opening 29 is defined by lower-side inner surface 291 and an upper-side inner surface 292. Indent 22 is provided on lower-side inner surface 291 side while indent 26 is provided on upper-side inner surface 292 side.

Opening 29 is a space for inserting plate-like terminal 50, and formed to extend in the longitudinal direction. Frame member 24 adjacent to indent 22 contacts rotary members 23 to hold rotary member 23, so that rotary members 23 are tilted by a prescribed angle. Frame member 24 and rotary members 23 are formed by punching through one copper plate. Rotary members 23 are bent relative to the punched frame member 24 to attain the twist of rotary members 23 as shown in FIG. 3. The twist allows rotary members 23 to be biased in the direction approaching plate-like terminal 50, whereby an electric connection between plate-like terminal 50 and rotary members 23 is attained. While in the present embodiment rotary members 23 and frame member 24 are provided on lower-side inner surface 291 side, they are not limited to such a manner and rotary members 23 and frame member 24 may be provided on upper-side inner surface 292 side. Rotary members 23 are tilted in the direction that is perpendicular to the insert direction of plate-like terminal 50 indicated by arrow 301 and that crosses the direction along which lower-side inner surface 291 is formed.

Figure 4:
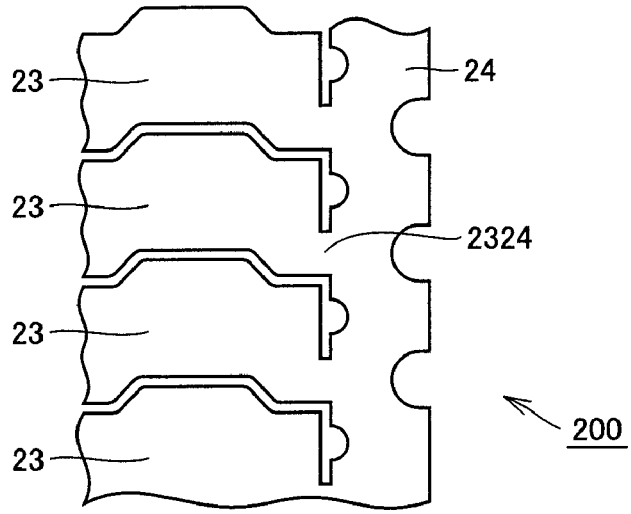
FIG. 4 is a plan view showing a manufacturing method of a contacting member and a frame member.

FIG. 4 is a plan view showing a manufacturing method of the contacting members and the frame member. Referring to FIG. 4, frame member 24 and rotary members 23 are formed by cut-out working of a copper plate 200. Thereafter, rotary members 23 are deformed so that rotary members 23 are tilted relative to frame member 24 as shown in FIG. 3. As the cut-out working, punching working such as pressing, or partial removal using laser may be employed.

By appropriately changing the width of connecting portions 2324 between frame member 24 and rotary members 23, the biasing force of rotary members 23 can be changed. By increasing the biasing force, the contact between bus bar 20 and plate-like terminal 50 can be ensured. When bus bar 20 and plate-like terminal 50 are fasted by a bolt or the like, the problem of poor contact does not arise. However, in the present invention, bus bar 20 and plate-like terminal 50 are connected without using a bolt. In this case, in order to solve the problem of poor contact, the biasing force of rotary members 23 to plate-like terminal 50 is set to be great.

Figure 5:
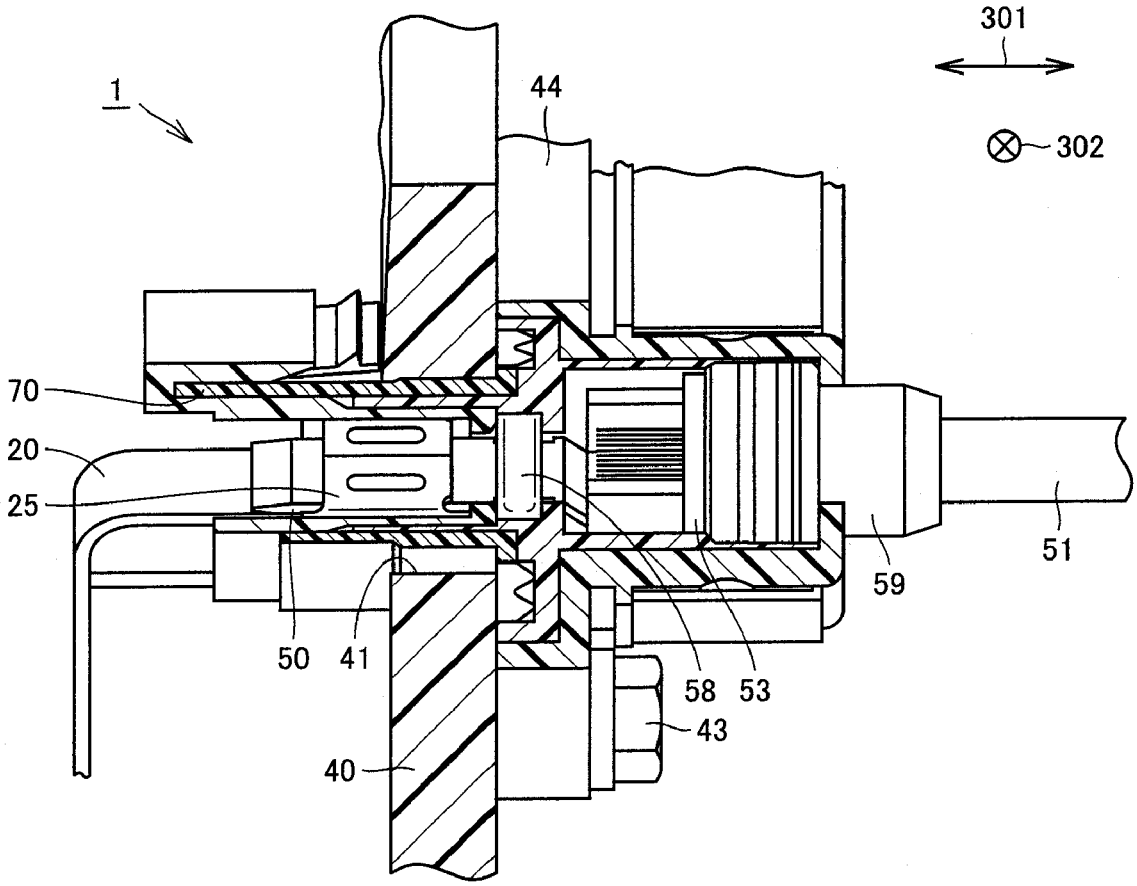
FIG. 5 is a perspective view including a partial cross-sectional view of the connector type terminal block structure shown in FIG. 1.

FIG. 5 is a perspective view including a partial cross-sectional view of the connector type terminal block structure shown in FIG. 1. Referring to FIG. 5, bus bar 20 mates with plate-like terminal 50, to attain the shape where they are mated with each other. This connecting portion is covered by a front holder 70 as a front cover. Front holder 70 is arranged so as to be in contact with an inner surface of hole 41. Seal member 58 is provided at the opening portion of front holder 70. Seal member 58 has a ring-like shape, inside which plate-like terminal 50 is mated. Upper surface portion 25 of bus bar 20 extends in parallel with the plane portion of plate-like terminal 50.

Front holder 70 covers the terminal block that constitutes the connecting portion between bus bar 20 and plate-like terminal 50, and serves to prevent deformation of the terminal block. Front holder 70 serves to prevent external force from being applied to the connecting portion between bus bar 20 and plate-like terminal 50.

Figure 6:
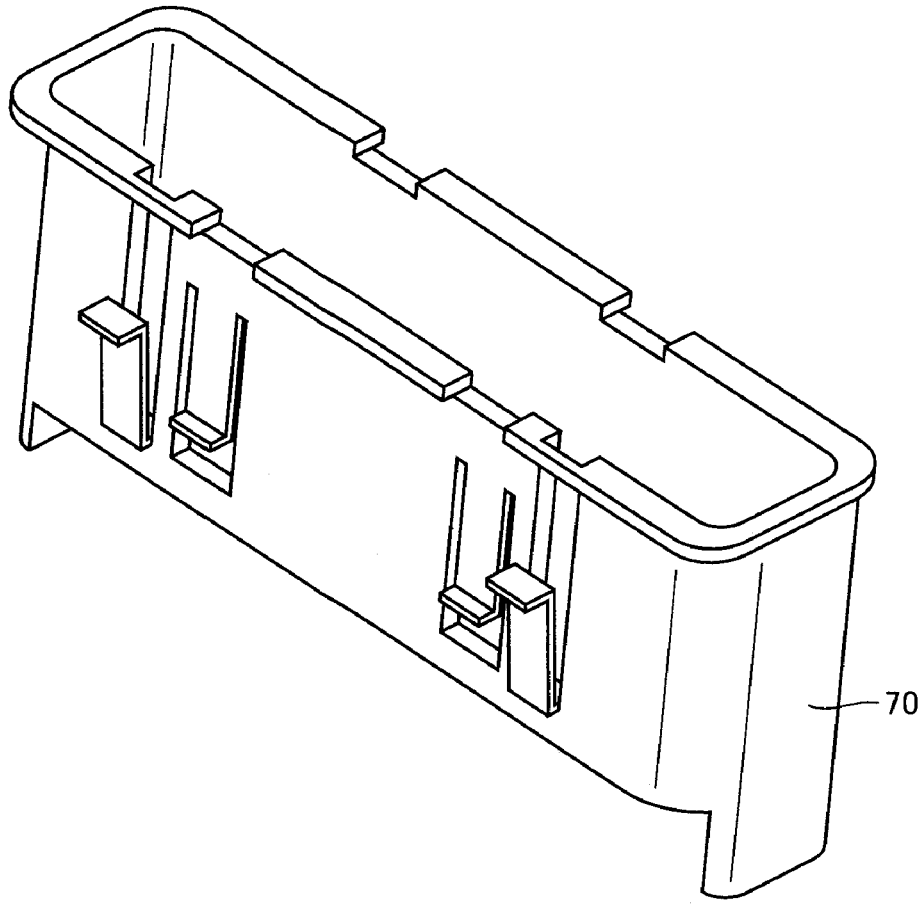
FIG. 6 is a perspective view of a front holder.

FIG. 6 is a perspective view of the front holder. Referring to FIG. 6, front holder 70 is tubular, inside which each terminal is mated. Front holder 70 is provided with a nail portion for engaging with the housing.

Figure 7:
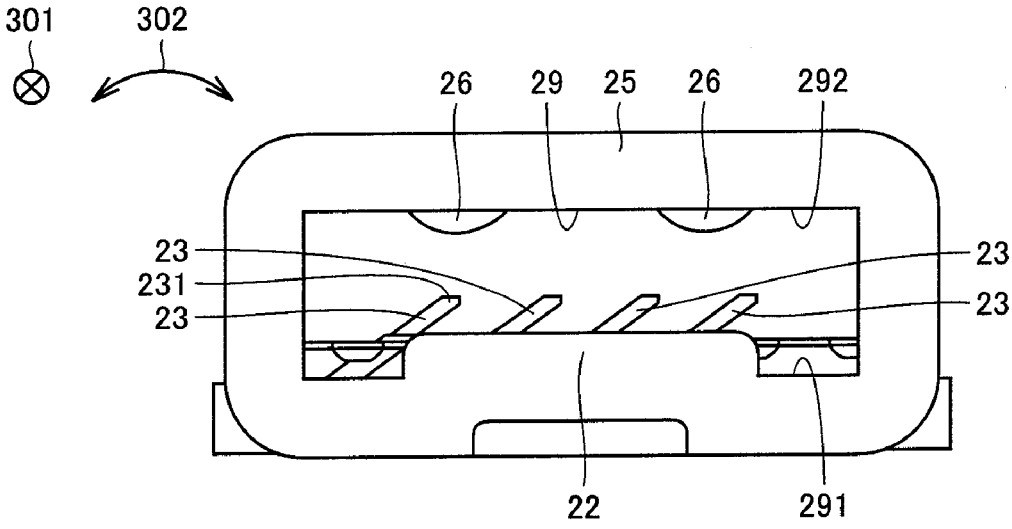
FIG. 7 is a front view of an opening portion of the bus bar.

FIG. 7 is a front view of an opening portion of the bus bar. Referring to FIG. 7, opening 29 is defined by upper-side inner surface 292 and lower-side inner surface 291. Upper-side inner surface 292 and lower-side inner surface 291 are arranged substantially in parallel with each other. Upper-side inner surface 292 is provided with a plurality of protruding indents 26. The number of indents 26 are not limited to two as shown in FIG. 7, and more or fewer indents 26 may be provided. Indents 26 extend in the longitudinal direction of the bus bar, and arranged in parallel with each other. As to the arrangement also, indents 26 are not necessarily be linear and in parallel with each other, and each of them may extend meandering. Further, indents 26 may be arranged to be tilted relative to the longitudinal direction. While the height of indents 26 in FIG. 7 is even, the height of indents 26 of convex shape (protruding shape) may not be even.

Indent 22 is arranged on lower-side inner surface 291 opposing to indents 26. Indent 22 has a table-like shape rising from lower-side inner surface 291, and defines the insert path of the plate-like terminal to be inserted.

A plurality of rotary members 23 rise from lower-side inner surface 291. Rotary members 23 are capable of rotating in the direction shown by arrow 302. Rotary members 23 contact the plate-like terminal and thereby rotate toward the lower side (the lower-side inner surface 291 side). When the plate-like terminal is inserted in the direction indicated by arrow 301, the plate-like terminal contacts and presses down rotary members 23, and rotary members 23 rotate downwardly. As rotary members 23 are biased upwardly, the contact between the plate-like member and rotary members 23 can be ensured at a plurality of portions. When pulling out the plate-like member from opening 29, as the force of the plate-like member pressing rotary members 23 is eliminated, rotary members 23 return to the position shown in FIG. 7.

Figure 8A:
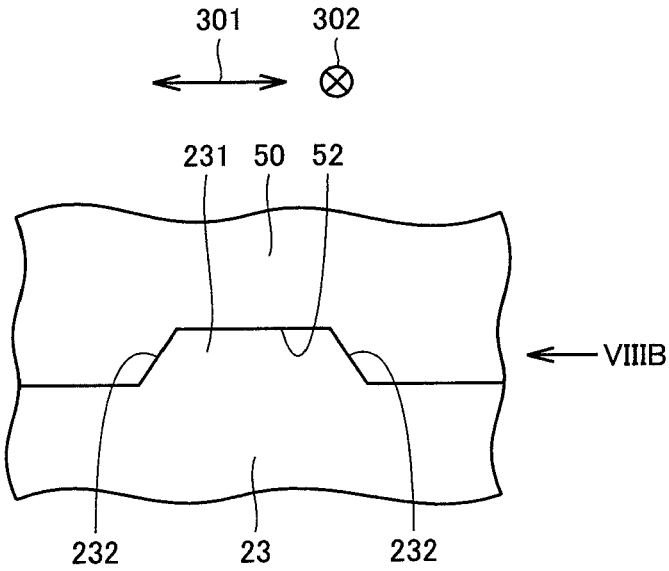
FIGS. 8A-8D show the bus bar in contact with the contacting member.
Figure 8B:
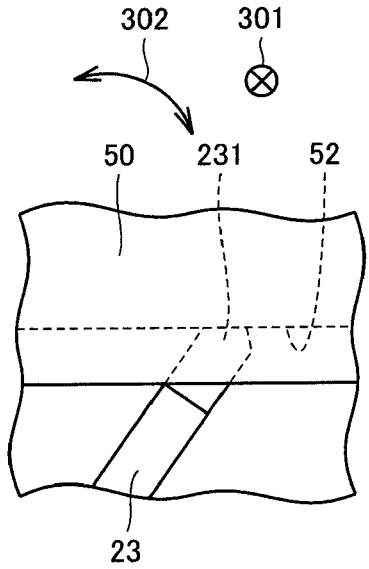
Figure 8C:
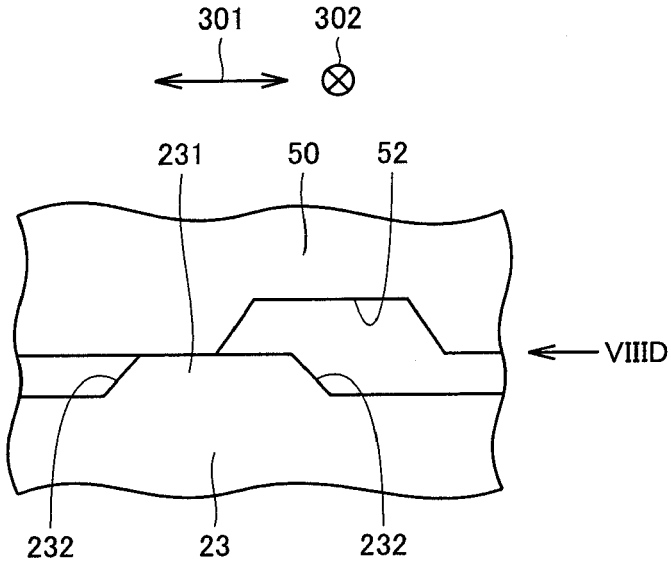
Figure 8D:
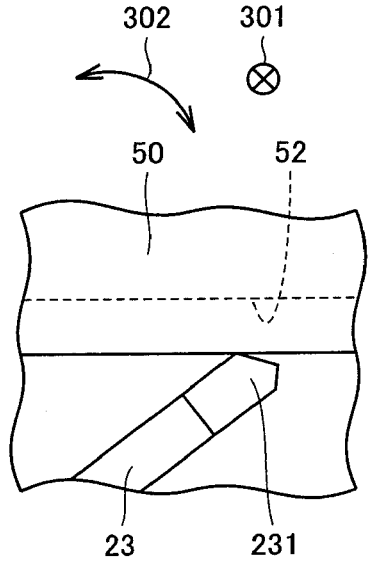

FIGS. 8A-8D show the bus bar in contact with the contacting members. FIG. 8A is a side view. FIG. 8B is a front view seen from the direction indicated by an arrow VIIIB in FIG. 8A. FIG. 8C is a side view of the bus bar and the contacting members. FIG. 8D is a front view seen from the direction indicated by an arrow VIIID in FIG. 8C. Referring to FIG. 8A, when plate-like terminal 50 of a bus bar shape is fully in contact with rotary members 23, tip portion 231 of a protruding shape mates with concave portion 52. While tip portion 231 has a convex shape and plate-like terminal 50 is provided with concave portion 52, conversely, tip portion 231 may be provided with a concave portion and plate-like terminal 50 may be provided with a convex portion.

As shown in FIG. 8B, tip portion 231 of each of rotary members 23 mates with concave portion 52 of plate-like terminal 50. As shown in FIG. 8C, when pulling out plate-like terminal 50, a tilt surface 232 of tip portion 231 is disengaged from concave portion 52, and tip portion 231 rotates in the direction indicated by arrow 302. That is, rotary members 23 rotate downwardly. As shown in FIG. 8D, tip portion 231 having been engaged with concave portion 52 is disengaged from concave portion 52, and rotary members 23 rotate downwardly than in FIG. 8B. In this state, plate-like terminal 50 is pulled out.

In the connector structure according to the present invention as described above, the electric connection is ensured by bus bar 20 as a first connector component and plate-like terminal 50 as a second connector component mating with each other. At bus bar 20, opening 29 into which plate-like terminal 50 is inserted is formed. Lower-side inner surface 291 as a first inner surface defining opening 29 is provided with rotary members 23 as a plurality of conductive contacting members, which rotate in the direction indicated by arrow 302 substantially perpendicular to the direction indicated by arrow 301 in which plate-like terminal 50 is inserted. Furthermore, frame member 24 holding rotary members 23 and connected to bus bar 20 is provided. Rotary members 23 are twisted relative to frame member 24 and thereby being biased to plate-like terminal 50. By plate-like terminal 50 being inserted into and pulled out from bus bar 20, rotating members 23 receive force from plate-like terminal 50 and rotate within a plane substantially perpendicular to the direction in which plate-like terminal 50 is inserted and pulled out. Frame member 24 and rotary members 23 are formed by cutting out copper plate 200 as a common conductive plate.

Tip portions 231 of rotary members 23 are each provided with tilt surface 232 that is tilted relative to the direction indicated by arrow 301 in which plate-like terminal 50 is inserted into bus bar 20. Opening 29 is defined by upper-side inner surface 292 as the second inner surface opposing to lower-side inner surface 291. Lower-side inner surface 291 is provided with indents 21 and 22 as a plurality of protrusion in the forward-backward direction of insertion of plate-like terminal 50 relative to rotary members 23, whereby abutment on plate-like terminal is enabled. Upper-side inner surface 292 is provided with indent 26 as a second protrusion that can abut on plate-like terminal 50, between indents 21 and 22. Connector type terminal block structure 1 includes base member 30 and housing 40 holding the connector structure, stator terminal 10 fixed to base member 30 with bus bar 20, and bolt 31 as a fixing member fixing stator terminal 10 and bus bar 20 to base member 30. Connector type terminal block structure 1 further includes front holder 70 as a terminal cover that stores bus bar 20 and plate-like terminal 50.

The structure according to the present invention as described above can be modified in various manners. For example, rotary members 23 may not only be formed by a copper material, but it also may be plated by silver or the like to attain a multi-contact spring structure.

Although the present invention has been described and illustrated in detail, it is clearly understood that the same is by way of illustration and example only and is not to be taken by way of limitation, the spirit and scope of the present invention being limited only by the terms of the appended claims.

The invention claimed is:

1. A connector structure, comprising:

a first connector component; and a second connector component mating with said first connector component to ensure an electric connection, wherein an opening into which said second connector component is inserted is formed at said first connector component, a first inner surface defining said opening is provided with a plurality of conductive rotary members that abut on said second connector component and that rotate in a direction substantially perpendicular to a direction in which said second connector component is inserted, and a frame member that holds said rotary members and that is connected to said first connector component, said rotary members are twisted relative to said frame member and thereby biased relative to said second connector component, by said second connector component being inserted into and pulled out from said first connector component, said rotary members receive force from said second connector component and rotate within a plane substantially perpendicular to a direction in which said second connector component is inserted and pulled out, and said frame member and said rotary members are formed from working of a common conductive plate;

wherein a tip portion of each of said rotary members is provided with a tilt surface that is tilted relative to a direction in which said second connector component is inserted into said first connector component.

2. The connector structure according to claim 1, wherein said opening is defined by a second inner surface opposing to said first inner surface, said first inner surface is provided with a plurality of first protrusions, wherein one of the first protrusions is provided forward of the rotary members and another of the first protrusions is provided backward of the rotary members with respect to a direction of insertion of said second connector component, whereby abutment on said second connector component is enabled, and said second inner surface is provided with a second protrusion between said plurality of first protrusions that can abut on said second connector component.

3. A connector type terminal block structure, comprising:

a base member holding the connector structure according to claim 1;

a stator terminal fixed to said base member with said first connector component; and a fixing member fixing said stator terminal and said first connector component to said base member.

4. The connector type terminal block structure according to claim 3, further comprising a terminal cover mounted to said base member to store said connector terminal.

5. The connector structure according to claim 1, wherein the one of the first protrusions and the other of the first protrusions extends in a direction perpendicular to the direction of insertion of said second connector component.

* * * * *